362-113
2/5/80 XR 4,186,851 SR

United States Patent [19]
Cantor

[11] 4,186,851
[45] Feb. 5, 1980

[54] NON-LETHAL PERSONAL DEFENSE WEAPON

[75] Inventor: Burton M. Cantor, Las Vegas, Nev.

[73] Assignee: Personal Security Concepts, Inc., Columbus, Ohio

[21] Appl. No.: 926,270

[22] Filed: Jul. 20, 1978

Related U.S. Application Data

[63] Continuation of Ser. No. 771,786, Feb. 24, 1977, abandoned.

[51] Int. Cl.[2] ..... B67D 5/66
[52] U.S. Cl. ..... 222/113; 222/470; 362/113; 362/114
[58] Field of Search ..... 222/78, 79, 113, 192, 222/402.11, 402.13, 470, 472–474, 508, 509; 42/70 R, 70 D; 239/289; 362/111–114

[56] References Cited

U.S. PATENT DOCUMENTS

| | | | |
|---|---|---|---|
| 2,453,683 | 11/1948 | Caldow | 42/70 D |
| 2,629,516 | 2/1953 | Badham | 362/112 X |
| 2,975,680 | 3/1961 | Wilson | 42/70 D X |
| 3,035,738 | 5/1962 | Bloom | 222/113 |
| 3,158,292 | 11/1964 | O'Donnell | 222/402.13 X |
| 3,189,232 | 6/1965 | Joffe | 222/402.13 |
| 3,638,836 | 2/1972 | Vickers III | 222/113 |
| 3,776,429 | 12/1973 | DeLucia | 222/192 X |
| 3,949,508 | 4/1976 | Elkas | 42/70 D X |

*Primary Examiner*—David A. Scherbel
*Assistant Examiner*—Fred A. Silverberg
*Attorney, Agent, or Firm*—Jerome P. Bloom

[57] ABSTRACT

A non-lethal personal defense weapon providing for the simultaneous projection of a high intensity beam of light and a concentrated chemical spray designed to immobilize attackers. The weapon features a spray discharge having a range up to 10 feet and embodies a simple but effective safety which avoids accidental discharge of the spray. The spray discharge and the light emitting mechanism are controlled by a two-position switch which insures that the high intensity beam of light and the spray discharge may be substantially simultaneously energized.

15 Claims, 7 Drawing Figures

NON-LETHAL PERSONAL DEFENSE WEAPON

This is a continuation of application Ser. No. 771,786 filed Feb. 24, 1977, now abandoned.

BACKGROUND OF THE INVENTION

This invention relates to improvements in personal non-lethal defensive weapons and more particularly to such a weapon having the capability of simultaneously projecting an intense beam of light and a powerful immobilizing spray of chemicals. Preferred embodiments feature a simple but a highly effective safety which prevents the inadvertent discharge of contained chemicals.

With the ever increasing occurrences of criminal attack on individuals, particularly on females, it has become self-evident that there is a need for a more effective means and method of coping with the same with some reasonable hope of escape. Many proposals have been offered in this respect, such as special flashlights and mace-type guns, but none thereof have appeared to be totally adequate for the purpose intended. For example, most of the personal defense weapons capable of economical manufacture and having an ability to discharge chemicals have lacked an effective range of use. Where lights have been embodied it has not heretofore seemed possible to inexpensively provide an intensity thereof that would serve any useful defensive purpose. These problems are apart from the basic concern of individuals that chemical guns are often subject to accidental discharge.

It was with the above in mind that the improvements of the present invention were developed.

SUMMARY OF THE INVENTION

Embodiments of the present invention comprise a housing having connected therewith means for the delivery therefrom of a jet-like discharge of fluid and for the production and emission of a high intensity beam of light. Operator means included in connection with said housing are so provided as to enable the jet-like discharge of fluid and the emission of light to occur substantially simultaneously. A simple safety device can be set to prevent an accidental discharge of the fluid without affecting the use of the light.

In the preferred embodiment illustrated the housing contains a supply of said fluid and associated pump means. The energization of the pump produces a jet-like discharge of the fluid by way of a delivery line having a changing cross sectional area. The bore of the delivery line is staged to concentrate the energy of the flow therethrough and to cause the fluid to discharge in a form and pattern the effective range of which is substantially in excess of three feet and as much as ten feet.

The housing embodies a relatively low voltage lamp or bulb as its light emitting source. The voltage rating of the bulb is so proportioned to and reduce from that of a battery provided interiorly of the housing as its source of power that, when energized, the bulb functions to produce a high intensity beam of light. The bulb and battery are embodied in a circuit including a normally open two-position switch. The switch is incorporated in a wall of a sleeve which mounts, for reciprocal movement therein, an operator element for the light and pumping means. Moving the operator in one direction causes a closing of the switch producing said high intensity beam of light and a split second thereafter an engagement and energizing of said pumping means. The timing is such that the pumping occurs substantially simultaneously with the closing of said switch.

The operator element has a control portion which projects through aligned elongate slots in said sleeve and a side edge of said housing. Its reciprocal movement is so determined. Outwardly of said housing said control portion nests in an offset portion of an elongate plate which forms a cap guided for movement in a straight line path defined by edge portions of said housing. Sliding said cap towards one end of said path carries said control portion, and said operator element therewith, to produce a closing of said switch just before the cap reaches the end of said path and almost instantaneously, a fraction of a second thereafter, an energization of said pump. Sliding the cap to the other end of the path results in the switch assuming its normally open position and the pump being deenergized. A rotor-like control element secured in and to said edge portion of said housing mounts for rotation with respect to said housing and includes, exterior to said housing, a plate-like head of non-circular peripheral configuration. On rotation of said rotor and an appropriate positioning of said head one may positively prevent said cap from reaching a position in which it can energize said pump.

It is therefore a primary object of the present invention to provide a non-lethal personal defense weapon which is economical to fabricate, more efficient and satisfactory in use and unlikely to malfunction.

Another object of the invention is to provide a personal defense weapon having a greater power to deter would-be attackers.

A further object is to provide a personal defense weapon having a capability of emitting a high intensity beam of light and substantially simultaneously projecting an intense jet-like discharge of chemical.

An additional object of the invention is to provide a personal defense weapon with simplified controls for inhibiting an accidental discharge of contained chemicals.

Another object of the invention is to provide a non-lethal personal defense weapon possessing the advantageous structural features, the inherent meritorious characteristics and the means and mode of operation herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawing wherein is shown one but not necessarily the only form of embodiment of the present invention, FIG. 1 is a perspective view of a weapon per the present invention taken from the front and one side thereof;

Like parts are indicated by similar characters of reference throughout the several views.

Figures 1, 2, 3, 4, 5, 6, 7:
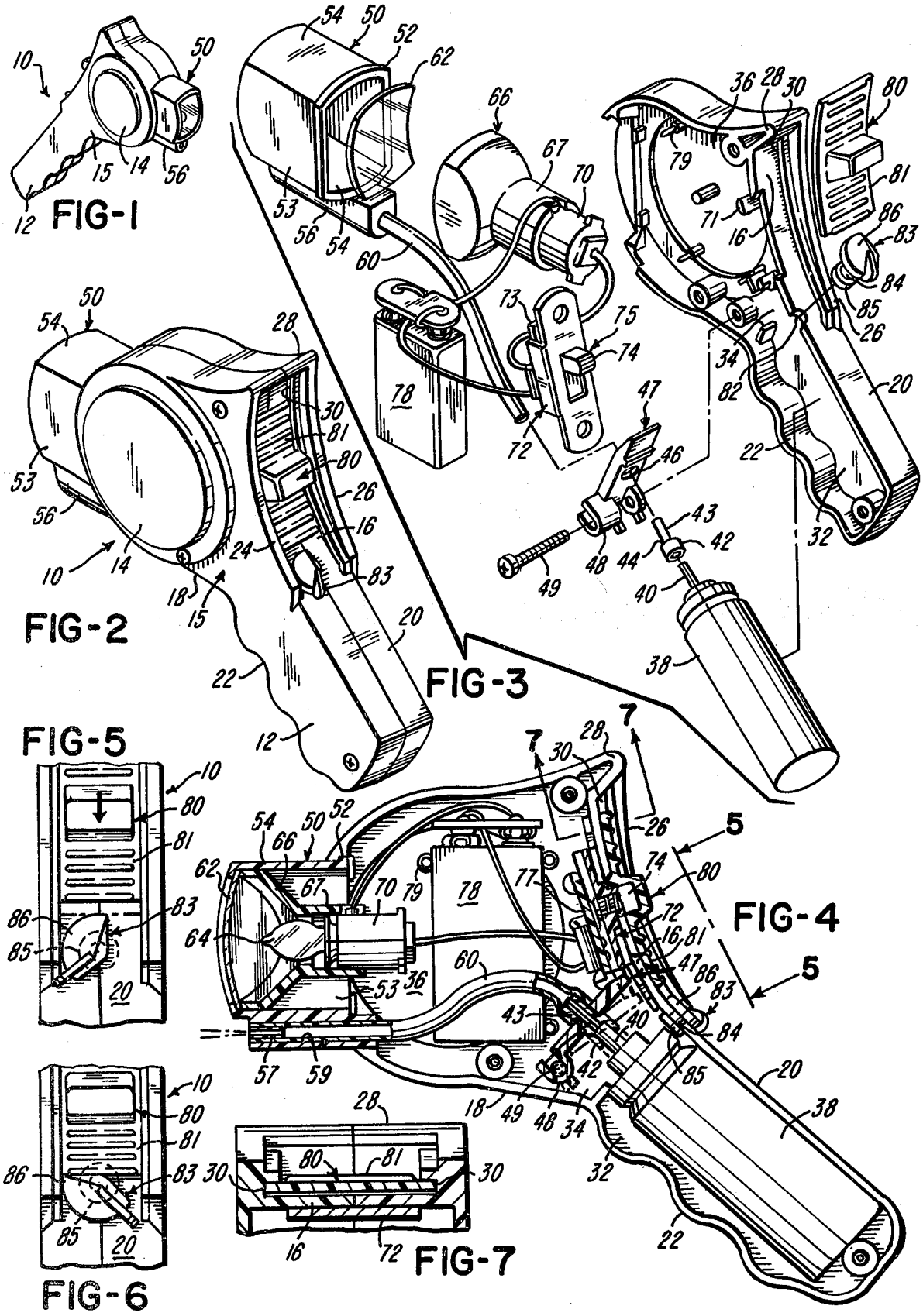
FIG. 2 is another perspective view of the weapon of FIG. 1 taken from the rear and the opposite side thereof, the view being on an enlarged scale.
FIG. 3 is an exploded view of the illustrated weapon, one side of its housing being eliminated for clarity of disclosure.
FIG. 4 is a side elevation view of the weapon with one part of its housing removed and certain parts shown in section.
FIG. 5 and FIG. 6 are fragmentary views which respectively illustrate the safety embodied in the subject weapon, the safety being first shown in an "on" position and then in an "off" position.
FIG. 7 is a view taken on line 7—7 of FIG. 4.

The embodiment of the invention illustrated comprises a housing 10 the configuration of which, in profile, reveals a generally rectangular elongate grip or handle section 12 projecting from and generally radial to a main body section 14 of generally circular outline, with which it is joined by a transition section 15. The section 15 includes parallel front and back wall portions the upper and lower edges of which are bridged, respectively, by upper and lower wall segments 16 and 18. The latter are arranged to diverge as they extend the upper and lower wall segments 20 and 22 of the grip 12 and merge with the outer peripheral wall segment 19 of the main body section 14, in a sense generally tangential thereto. In profile the upper wall segment 16 has a gentle curve the radius of which is relatively large and it is bounded at its front and back edges by integrally formed perpendicularly and outwardly projected shallow wall sections 24 and 26. The uppermost ends of the wall sections 24 and 26 which merge with the main body section 14 are bridged by a connecting wall segment 28. The wall segment 16 is therefore contained within and bounded on three sides by the wall segments 24, 26 and 28. Each of the innermost facing surfaces of the wall segments 24 and 26 has means defining thereon, at its base, a groove 30 which follows the profile of the wall segment 16.

As fabricated per the preferred embodiment illustrated, the housing 10 is split longitudinally thereof in a plane which is centered between its front and rear faces. Thus, as will be obvious, the housing 10 is comprised of front and rear halves. These halves are brought together and simply secured, in this case, by the application of conventional screws. As so provided, the housing 10 may be considered to form, interiorly thereof, three chambers. These chambers comprise a chamber 32 in the grip portion 12 followed by a short expanding transition chamber 34 in the housing section 15, which is followed in turn by a chamber 36 in the body section 14, the latter of which chambers has a generally circular peripheral configuration.

Nested in the chamber 32 is a bottle 38 forming a container for fluid the properties of which are such that when sprayed in the face of a person or animal, the person or animal will be temporarily disabled. In the preferred embodiment of the present invention this chemical will comprise a mixture of an alcohol, such as isopropyl alcohol, and pepper, oleo capsaicin resin, dissolved therein. When this fluid hits the face of an attacker, it will cause his or her eyes to become greatly irritated and water to such an extent it becomes very difficult for the attacker to see. On reaching the nose and throat it will severly irritate the mucous membrane and cause gasping and violent sneezing. The direct and immediate effect is to immobilize the attacker.

In the case illustrated, the bottle 38 is provided with a conventional piston or pump type operator, the operation of which will induce a discharge of the bottle contents, in a jet-like flow, by way of a small bore rigid tube 40. The latter is connected for movement with the included piston. The details of the pumping mechanism including the piston are not here illustrated or described since such details do not per se form part of the present invention. Moreover, such details may be conventionally provided in various manner by a mechanic versed in the art.

As seen in FIGS. 3 and 5 of the drawings, the projected extremity of the tube 40 extends into the transition chamber 34 where it is frictionally fixed in one end of a short tubular adapter 42 which has a substantial wall thickness. Projected in and fixed to the remote end of the adapter 42, to form an internal shoulder to which the projected extremity of the tube 40 may be abutted, is one end of a smaller bore tube 43. The end of the adapter 42 which accommodates the one end of the tube 43 provides a shoulder 44 about and in rimming relation to this inserted end of the tube 43.

In the application of the assembly comprised of the bottle 38, the tube 40, the adapter 42 and the tube 43, the projected extremity of the tube 43 is thrust through a central aperture 46 in a plate-like lever 47 positioned to substantially bridge the transition chamber 34 intermediate its ends. In the process, the shoulder 44 on the adapter 42 is brought into abutted relation with the adjacent face of the lever 47. Formed integral with the lever 47, at the one end thereof adjacent the wall segment 18, are means defining a strap-like extension 48 looped in part to form a passage transverse to the lever which accommodates a screw 49. The screw 49 is threadedly engaged in a boss connected integral with and projected perpendicular to the rear wall of the chamber 34. In this manner the plate-like lever is mounted for pivotal movement to and from the adjacent end of the bottle 38. As will be further described, due to its bearing relation on the shoulder 44, in the movement of the lever 47 towards the bottle 38 it will, through the medium of the adapter 42 and the integrated end of the tube 43, move the tube 40 inwardly of the bottle 38 to operate its pumping mechanism including the piston (not shown). This will produce a pressured flow of the liquid chemical in the bottle 38 outwardly thereof by way of the tube 40 and the tube 43.

As first mentioned, in the case of the embodiment illustrated, the housing 10 is formed of mating front and back half sections, each of which includes a half portion of its peripheral wall structure. At certain locations the mating edges of the half portions of this peripheral wall structure have identical complementary cutouts. One such arrangement is at a location forwardly of and substantially 135° from the location at which the grip 12 joins the peripheral wall segment 19 of the body section 14. The mating cutouts here provided accommodate the mount in and projection from the housing section 14 of a tubular lamp housing 50. The cutouts are configured to have their mating edges immediately confine this housing which in cross section includes parallel side wall sections 52 bridged respectively at their top and bottom edges by convexly curved wall sections 54. The innermost end of the housing 50 has an external flange 52 the remote side portions of which are accommodated in means defining groove-like recesses in the front and rear inner faces of the mating half sections of the housing 10. Integral with the relatively dependent apex portion of the bottom section 52 of the housing 50 is a longitudinally extending bar-like projection 56 the forwardmost end of which is slightly to the rear of the forwardmost end of the housing 50 and the rearmost end of which extends inwardly of the housing 50 and into the chamber 36, adjacent its lower edge.

The projection 56 is provided, longitudinally thereof, with a bore defining a passage 59. The passage 59 accommodates therein, in fixed relation to the projection 56, the discharge end portion of a short flexible tube 60 the opposite end of which is slipped over and frictionally coupled to the projected extremity of the tube 43 which is to the face of the lever 47 remote from the bottle 38. A short plug-like tubular insert 57 is fixed in the discharge end of the tube 60 which positions in the forwardmost end of the passage 59. The bore of the insert 57 is reduced in diameter from that of the passage defined by the tube 60 so as to be pin-like in character. From the foregoing it will be seen that the small bore passage of the tube 43 is extended by the tube 60 to a point interiorly of the bore formed in the projection 56, at which point it is restricted by the insert 57 which defines a discharge nozzle for the chemical pumped from the bottle 38. The effect of the insert 57 is to concentrate the energy in the flow from the bottle 38, when a discharge is triggered, in a manner providing that the chemical issues from the nozzle in such a concentrated form and pattern that the spray thereof will have a range up to and in the neighborhood of ten feet.

The end of the lamp housing 50 projecting outwardly of the body section 14 includes a narrow internal flange seated to which is the peripheral edge of a clear lens 62 which bridges the housing. Immediately inward of the lens 62 is the projected extremity of a bulb 64 the neck of which is centered in and projected through an aperture in a cup-like adapter 66 nested in the housing 50 which provides behind the bulb, and facing outwardly therewith, a parabolically shaped reflector surface. The adapter 66 embodies in connection with the rear thereof a sleeve-like projection 67 one end of which is in rimming relation to the aperture in the adapter. The bulb 64 is threadedly engaged in a receptacle 70 which is slip fit in the sleeve 67. A stud-like projection on the outer surface of the receptacle 70 nests in a notch in the innermost end of the sleeve to properly position the receptacle and to preclude its relative rotation when assembled to the adapter 66, as illustrated in FIG. 4.

Mounted in the chamber 36, immediately inward of the upper wall segment 16 of the housing 10 is a sleeve-like structure 72. The structure 72 is rectangular in cross section, open to each of its opposite ends and includes an elongate slot in the side thereof adjacent the wall segment 16. The sleeve 72 is frictionally fixed between the wall segment 16 and adjacent parallel flatted surfaces of pin-like projections 71 formed integral with and projected perpendicular to the back wall of the housing 14. The head 73 of a T-shaped operator element 75 is slidably mounted and contained in the sleeve structure 72 while the leg portion 74 of the element 75 projects outwardly through the slot in the sleeve and through an aligned slot in and at the uppermost end of the wall segment 16. The slots have a length such that in a reciprocal movement of the operator element 75 one end of the head 73 will in the uppermost position of the leg portion 74 project outwardly of the upper end of the sleeve while the other end of the head 73 will in the lowermost position of the leg 74 project outwardly of the lowermost end of the sleeve. As will be obvious, the length of the slots determines the extent of travel of the leg 74 in the course of its movement. Referring to the drawings, the head 73 of the operator 75 has a groove in its exterior surface nesting a spring biased stud adapted in a reciprocal movement of the operator 75 to engage a series of contacts embodied in a facing wall portion of the sleeve 72 and form therewith a switch 77. In FIG. 4 of the drawings, this switching arrangement is shown in its normally open condition. The switch 77 is embodied in a control circuit which also incorporates the socket portion of the receptacle 70 and a battery 78, the latter of which is nested in the rear half of the housing portion defining the chamber 36, within an area where it is bounded and peripherally contained by a series of pins 79 projected from and perpendicular to the inner face of the rear wall of the chamber 36. As will be obvious, the circuit so provided functions to energize the bulb 62 when the switch 77 is in a closed condition. With the arrangement provided the switch 77 will be closed when the operator element 75 is moved to adjacent the lower end of its permissible travel, at which time the lowermost end of the head 73 projects from the sleeve 72 and a split second after the switch 77 is closed engages the projected extremity of the lever 47, which is in the path thereof, and depresses it with respect to the bottle 38. A consequence of this last action is that the bulb 64 is energized substantially at the same time as the depression of the lever 47 results in the pumping from the bottle 38 and a discharge from the nozzle 57 of a high intensity spray of chemicals.

In the embodiment illustrated the battery 78 will have a 9 volt rating and the bulb which it powers will have a 6 volt rating, the ratings being proportioned so that the bulb when energized will serve to provide a high intensity beam.

To facilitate the manipulation and control of the operator element 75, the outwardly projected end of the leg portion 74 thereof is contained in an offset portion 80 centrally of a plate-like strip 81. The device 81 as so provided forms a cap and the portion thereof rimming the offset is adapted to ride on the outermost surface of the wall segment 16, being appropriately configured to this end. The lateral extremities of the device 81 are arranged at the same time to ride in and be contained in the grooves 30 in the bounding side wall segments 24 and 26 on the housing 10.

Formed in the upper wall segment of the grip portion 12 at the point where it joins the lower end of the wall segment 16 is an aperture 82 defined by cutouts in the mating edges of peripheral portions of the half sections of the housing 10. The aperture 82 accommodates the projection therethrough of the shaft 84 of a safety element 83. Formed integral with the inner end of the shaft 84 is a plate-like head of disc shape restricting the movement of the shaft outwardly of the housing 10. Formed integral with the outermost end of the shaft 84 is a plate-like head 85 projecting radially outward of the shaft 84 and having a configuration in the nature of a 120° sector of a circle including a radially oriented lever-like projection adjacent one edge. As seen in FIGS. 5 and 6, the safety element 83 may be rotated to orient, as shown in FIG. 5, to prevent the movement of the cap 81, and thereby the movement of the operator element 75, beyond the precise position at which it causes the switch 77 to close. This insures an inability of the operator of the invention unit to move the operator 75 that slight additional distance necessary to depress the lever 47 sufficient to pump the chemical from the bottle 38. Of course, with the safety device 83 in the position shown in FIG. 6, the operator element 75 is permitted full freedom of movement in operation.

It is to be understood that the nature of the switch 77 as herein illustrated is merely by way of example and not by way of limitation. It is believed that anyone versed in the art will understand the requirements based upon the parameters herein set forth.

From the foregoing it will be seen that as first stated herein the invention does provide a simple but effective non-lethal personal defense weapon having several novel and distinguishing features. By very simple means and method there has been provided a means for simply creating a high intensity beam of light and substantially simultaneously therewith a directionally oriented and concentrated delivery of a fluid in a pattern and form which extends for a distance up to ten feet. This has not heretofore been found possible in the design of personal defense weapons of the nature with which we are here concerned. Moreover, the invention provides for a simple but highly effective safety which prevents inadvertent discharge of contained chemical. The safety arrangement as herein illustrated requires a positive manipulation thereof to permit the discharge of chemical, yet it is easily accessible for this purpose and therefore can be quickly operated by one requiring the availability of the chemical on an instant's notice. Of particular importance as far as the embodiment of the safety is the positioning thereof with respect to the operator element required for the invention unit to function. The embodiment of the operator element, moreover, as here provided, enables the high intensity beam of light to be utilized alone while with the safety in the off position the operator of the invention unit can in one stroke produce the discharge of an immobilizing spray a split second after a blinding beam of light so that the two defensive aspects of the weapon function substantially simultaneously and produce the desired result. Of considerable advantage is the inclusion of a chemical such as herein described, particularly in combination with the preferred embodiment of the invention here illustrated. It has been found, for reasons not entirely understood, that the chemicals depend for their effectiveness, as to their immobilizing capabilities, for a projection through a discharge system such as herein illustrated and described.

It is to be understood that the configuration of a unit in accordance with the invention as herein described is preferred and lends facility to the use thereof but it is not intended by the disclosure herein provided to limit the configuration of the housing 10 to precisely that described.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications with the legitimate and valid scope of the appended claims.

The embodiments of the invention in which an exclusive property or privilege is claimed are defined as follows:

1. A non-lethal personal defense weapon comprising a housing, means for delivering from said housing a jet-like discharge of fluid having a capability of deterring attackers including means operable to activate the fluid discharge, means connected with said housing for emitting a beam of light, an operator device in connection with said housing movable in a substantially linear path, said operator device including, in association therewith and responsive to movement thereof means to actuate said light emitting means and substantially immediately after the actuation of said light emitting means to actuate said means operable to activate a discharge of fluid, said means to actuate said light emitting means and responsive to movement of said operator means including a normally open circuit, a circuit closure means being provided in connection with a portion of said actuating means and said actuating means being inclusive of a further portion which functions to induce the operation of said means operable to activate a discharge of fluid in the course of its movement in said substantially linear path, said housing comprising a rigid grip portion embodying a container of said fluid and a main body portion housing a power source for said light emitting means, said fluid delivery means being extended through said main body portion to and through an opening in a wall portion of said main body portion of said housing which mounts therein said light emitting means and said operator device being reciprocably movable along and in contact with an edge wall portion of said main body portion adjacent said rigid grip.

2. A weapon as in claim 1 wherein said housing embodies a supply of said fluid the form of which is a mixture including alcohol and pepper.

3. A weapon as in claim 1 wherein said housing includes a wall portion which embodies in connection therewith means for selectively blocking said operator device and said blocking means includes a disc-like rotatable part the peripheral configuration of which is non-circular and includes a portion adapted to be positioned in the path of and to limit the movement of said operator device in said substantially linear path.

4. A weapon as in claim 1 wherein said operator device has one position in said substantially linear path in which it serves to actuate said light emitting means and a second position in said path in which it serves both to maintain the actuation of said light emitting means and to actuate said means to activate a discharge of fluid.

5. A weapon as in claim 1 wherein said operator device which is reciprocably movable along and in contact with an edge wall portion of said main body portion is immediately above said rigid grip.

6. A weapon as in claim 1 wherein said actuating means includes said further portion thereof housed for movement in a sleeve, one wall of which mounts a portion of said circuit closure means which is embodied in said circuit which includes in connection therewith said light emitting means and said power source for said light emitting means, the closure of said circuit closure means by said actuating means actuating said light emitting means, and said operator device includes a portion projected exteriorly of said housing, through an opening therein, the engagement and movement of which is controlled to produce said movement of said operator device in said substantially linear path, in the course of which said portion of said actuating means closes said circuit closure means and said further portion thereof projects from one end of said sleeve to actuate said means operable to activate a discharge of fluid.

7. A non-lethal personal defense weapon comprising a housing, means for delivering from said housing a jet-like discharge of fluid having a capability of deterring attackers including means operable to activate the fluid discharge, means connected with said housing for emitting a beam of light, an operator device in connection with and movable substantially linearly with respect to said housing, said operator device including a substantially linearly movable operator element in association therewith carrying an electrical contact means operable in a portion of the linear movement of said element to close a circuit to energize said light emitting means, said element being constructed and arranged to physically engage and operate said means operable to activate a fluid discharge substantially immediately of the energization of said light emitting means and in an immediately following portion of the linear movement thereof.

8. A weapon as in claim 7, wherein said operator element in the line of its linear movement has a first position in which said operator element is non-functioning and a second position in which said light emitting means is energized and a third position in which said light emitting means continues to be energized and fluid discharge is activated, and said means operable to activate fluid discharge includes an actuating lever displaced by said operator element in the course of its movement from said second position to said third position.

9. A non-lethal personal defense weapon comprising a housing, means for delivering from said housing a jet-like discharge of fluid having a capability of deterring attackers, means connected with said housing for emitting a beam of light, an operator device in connection with and movable with respect to said housing, said operator device including means in association therewith and responsive to movement thereof to energize said light emitting means and substantially immediately of the energization of said light emitting means to activate said fluid delivery means, said operator device having one position in which it serves to energize said light emitting means and a second position in which it serves both to energize said light emitting means and to activate said fluid delivery means, said operator device being constructed and arranged to achieve said energization of said light emitting means and said activation of said fluid delivery means in a substantially uninterrupted linear movement thereof, and said operator device being operable to have said means in association therewith bear on and pivot a lever means which forms part of said fluid delivery means in moving to said second position thereof, in response to which said lever means operates to produce an ejection of fluid from a supply thereof contained in said housing.

10. A weapon as in claim 9, wherein said housing includes a wall portion embodying disabling means for selectively blocking movement of said operator device to its said second position.

11. A non-lethal personal defense weapon comprising a housing, means connected with said housing for delivering therefrom a jet-like discharge of fluid having a capability of deterring attackers and other means connected with said housing for emitting a beam of light, said housing including a section of circular outline which is relatively flat and forms a chamber containing a power source for said light emitting means, said light emitting means being exposed at a peripheral wall portion of said housing and directed in a sense generally radial to said housing section of circular outline, said housing further including a chamber at a location remote from said light emitting means projecting in a sense radial to said relatively flat section of circular outline and housing therein a supply of fluid to which said fluid delivery means is connected, an operator device in connection with and movable with respect to said housing, said operator device including means in association therewith and responsive to movement thereof to energize said light emitting means and substantially immediately of the energization of said light emitting means to activate said fluid delivery means, and said power source, a switch device and said light emitting means being connected in a suitable circuit which is closed to energize said light emitting means in the course of a substantially linear movement of said operator device, said fluid delivery means including a reciprocable tube communicating with said fluid supply and means for movement of said tube including a portion thereof lying in the path of movement of said means in association with said operator device and movable thereby to move said tube to produce an ejection of a portion of said supply from said housing, said operator device being constructed and arranged to achieve said energization of said light emitting means and movement of said tube in an uninterrupted substantially linear movement thereof.

12. A non-lethal personal defense weapon comprising a housing, means in said housing for delivering therefrom a jet-like discharge of fluid having a capability of deterring attackers, means for emitting a beam of light, said housing including a relatively flat section of circular outline forming a chamber containing means providing for application of power to said light emitting means, said light emitting means being exposed at a peripheral wall portion of said housing, said housing further including a second chamber containing a supply of said fluid, the wall portion of said second chamber providing a relatively rigid handle extending in a sense generally radial to said housing section of circular outline, an operator device in connection with and movable with respect to said housing having means in association therewith and responsive to movement thereof to energize said light emitting means and substantially immediately of the energization of said light emitting means to activate said fluid delivery means, said means in association with said operator device including one portion thereof housed for movement in a sleeve, one wall of which mounts means providing a normally open control switch embodied in a control circuit including said light emitting means and a power source for said light emitting means, the closure of said switch powering said light emitting means, and said operator device including a portion projected exteriorly of said housing, through an opening therein, the engagement and movement of which is controlled to produce a substantially linear movement of said operator device in one direction in the course of which said one portion of said operator device closes said switch and projects from one end of said sleeve to activate said fluid delivery means, said portion of said operator device projected exteriorly of said housing being provided with a cap contained for sliding movement on an exterior wall surface of said housing immediately above and substantially in line with an exterior surface of said handle which is an uppermost surface portion of said handle and embodies therein shiftable means for selectively restricting the linear movement of said operator device.

13. A weapon as in claim 12 wherein said restricting means includes in the line of movement of said operator device a plate-like segment resembling a section of a circle of approximately 120° the rotative position of which determines whether or not it has a movement restricting function.

14. A weapon as in claim 13 wherein said cap for said portion of said operator device which projects exteriorly of said housing mounts for movement on an edge portion of said housing which is inclined to and forms an upward continuation of an upper edge portion of said handle.

15. A weapon as in claim 12 wherein said operator device is constructed and arranged to provide that in a substantially uninterrupted linear movement thereof the operator device energizes said light emitting means and activates said fluid delivery means substantially simultaneously.

* * * * *

UNITED STATES PATENT AND TRADEMARK OFFICE

CERTIFICATE OF CORRECTION

PATENT NO. : 4,186,851

DATED : February 5, 1980

INVENTOR(S) : Burton M. Cantor

It is certified that error appears in the above-identified patent and that said Letters Patent are hereby corrected as shown below:

Col. 1, line 58, "reduce" is corrected to read -- reduced --.

Col. 6, line 11, "62" is corrected to read -- 64 --.

Signed and Sealed this

*Eighth* Day of *July 1980*

[SEAL]

*Attest:*

SIDNEY A. DIAMOND

*Attesting Officer*

*Commissioner of Patents and Trademarks*